US008550261B2

(12) United States Patent
Loftin et al.

(10) Patent No.: US 8,550,261 B2
(45) Date of Patent: Oct. 8, 2013

(54) PRODUCT DISPENSING SYSTEM WITH FLEXING CONTAINER

(75) Inventors: Caleb S. Loftin, Richmond, VA (US); William J. Bogdziewicz, Richmond, VA (US); Aaron L. Bates, Moseley, VA (US); John Gelardi, Midlothian, VA (US)

(73) Assignee: MeadWestvaco Corporation, Richmond, VA (US)

( * ) Notice: Subject to any disclaimer, the term of this patent is extended or adjusted under 35 U.S.C. 154(b) by 129 days.

(21) Appl. No.: 13/228,975

(22) Filed: Sep. 9, 2011

(65) Prior Publication Data

US 2013/0062361 A1 Mar. 14, 2013

(51) Int. Cl.
*A47F 1/04* (2006.01)
*A47F 7/00* (2006.01)

(52) U.S. Cl.
USPC ..... 211/59.2

(58) Field of Classification Search
USPC ..... 211/59.2, 59.3, 74; 221/175, 176, 185, 221/285, 287, 282, 197, 194, 198, 17, 31
See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |

(Continued)

FOREIGN PATENT DOCUMENTS

| | | |
|---|---|---|
| GB | 2190906 | 12/1978 |
| GB | 2303624 | 2/1997 |

(Continued)

OTHER PUBLICATIONS

International Search Report and Written Opinion issued in PCT/US2010/057020 (Mar. 8, 2011).

(Continued)

*Primary Examiner* — Darnell Jayne
*Assistant Examiner* — Kimberley S Wright
(74) *Attorney, Agent, or Firm* — MeadWestvaco Intellectual Property Group

(57) ABSTRACT

A product dispensing system including a dispenser having an upper support deck that defines a deck opening and a lower support deck that defines a product display area, a container positioned on the upper support deck, the container including first and second walls that define an internal volume, wherein the first wall defines an opening having a longitudinal length that is aligned with the deck opening, and wherein the second wall includes a lower portion proximate the container opening, and a plurality of products initially housed in the internal volume, wherein the dispenser is spaced from the lower portion of the second wall such that the lower portion bows outward and increases the longitudinal length when a product engages the lower portion as it exits the container through the container opening.

18 Claims, 6 Drawing Sheets

(56) References Cited

U.S. PATENT DOCUMENTS

| | | | |
|---|---|---|---|
| 2,263,353 | A | 11/1941 | Eidam |
| 2,291,187 | A | 7/1942 | Johnson |
| 2,382,191 | A | 7/1944 | Weichselbaum |
| 2,536,421 | A | 2/1951 | Burhans |
| 2,573,381 | A | 10/1951 | Arnold |
| 2,574,087 | A | 11/1951 | Burhans |
| 2,595,122 | A | 4/1952 | Burhans |
| 2,784,871 | A | 3/1957 | Gabrielsen |
| 2,795,845 | A | 6/1957 | Shimer |
| 2,818,978 | A | 1/1958 | Post |
| 2,826,471 | A | 3/1958 | Fonda |
| 2,831,591 | A | 4/1958 | Morton |
| 2,888,145 | A | 5/1959 | Knott et al. |
| 2,915,932 | A | 12/1959 | Gross |
| 2,919,488 | A | 1/1960 | Brownlee |
| 2,996,344 | A | 8/1961 | Garman |
| 3,018,149 | A | 1/1962 | Parker |
| 3,055,293 | A | 9/1962 | Lariccia |
| 3,066,827 | A | 12/1962 | Pryor |
| 3,137,068 | A | 6/1964 | Quigley |
| D198,888 | S | 8/1964 | Heselov |
| 3,178,242 | A | 4/1965 | Ellis et al. |
| 3,184,104 | A | 5/1965 | De Domenico et al. |
| 3,203,554 | A | 8/1965 | Pendergrast et al. |
| 3,204,335 | A | 9/1965 | Hughes |
| 3,288,544 | A | 11/1966 | Knecht |
| 3,300,115 | A | 1/1967 | Schauer |
| 3,304,141 | A | 2/1967 | Rogers |
| 3,318,455 | A | 5/1967 | Takahashi |
| 3,335,940 | A | 8/1967 | Dykes |
| 3,340,790 | A | 9/1967 | Simjian |
| 3,348,738 | A | 10/1967 | Hertlein |
| 3,392,901 | A | 7/1968 | Krzyzanowski |
| 3,393,808 | A | 7/1968 | Chirchill |
| 3,501,016 | A | 3/1970 | Eaton |
| 3,763,557 | A | 10/1973 | Sewell |
| 3,784,022 | A | 1/1974 | Beesley, Jr. |
| 3,922,778 | A | 12/1975 | Aalpoel |
| 3,923,159 | A | 12/1975 | Taylor et al. |
| 3,972,454 | A | 8/1976 | Croley |
| 4,105,126 | A | 8/1978 | Deffner et al. |
| 4,205,440 | A | 6/1980 | Morgan |
| 4,260,072 | A | 4/1981 | Quasarano |
| 4,382,526 | A | 5/1983 | Stone |
| 4,396,143 | A | 8/1983 | Killy |
| 4,435,026 | A | 3/1984 | Johnson |
| 4,467,524 | A | 8/1984 | Ruff et al. |
| 4,576,272 | A | 3/1986 | Morgan, Jr. |
| 4,598,828 | A | 7/1986 | Young et al. |
| 4,729,480 | A | 3/1988 | Groover et al. |
| 4,744,489 | A | 5/1988 | Binder et al. |
| 4,834,263 | A | 5/1989 | Becze |
| 4,869,395 | A | 9/1989 | Rubbmark |
| 4,911,309 | A | 3/1990 | Stefan |
| 4,915,571 | A | 4/1990 | Toshihiko et al. |
| 4,923,070 | A | 5/1990 | Jackle et al. |
| 4,997,106 | A | 3/1991 | Rockola |
| 4,998,628 | A | 3/1991 | Ross |
| 5,033,348 | A | 7/1991 | Walsh |
| 5,080,256 | A | 1/1992 | Rockola |
| 5,101,703 | A | 4/1992 | Tanaka et al. |
| 5,167,345 | A | 12/1992 | Bleeker |
| 5,251,972 | A | 10/1993 | Zurawin |
| 5,289,943 | A | 3/1994 | Powell |
| 5,314,078 | A | 5/1994 | Morikiyo et al. |
| 5,328,258 | A | 7/1994 | Scalise |
| 5,356,033 | A | 10/1994 | Delaney |
| 5,372,278 | A | 12/1994 | Leight |
| 5,390,821 | A | 2/1995 | Markel |
| 5,396,997 | A | 3/1995 | Johnson |
| D363,174 | S | 10/1995 | Fletcher, Sr. |
| 5,462,198 | A | 10/1995 | Schwimmer |
| 5,529,207 | A | 6/1996 | Oden et al. |
| 5,638,988 | A | 6/1997 | Rogers |
| 5,685,664 | A | 11/1997 | Parham et al. |
| 5,740,610 | A | 4/1998 | Ayer et al. |
| 5,788,117 | A | 8/1998 | Zimmanck |
| 5,791,048 | A | 8/1998 | Bodnar et al. |
| 5,836,478 | A | 11/1998 | Weiss |
| 5,878,862 | A | 3/1999 | Dewsnap |
| 5,894,942 | A | 4/1999 | Miyashita et al. |
| 5,992,286 | A | 11/1999 | Boole |
| 5,992,652 | A | 11/1999 | Springs |
| 6,186,345 | B1 | 2/2001 | Robertson |
| 6,199,720 | B1 | 3/2001 | Rudick et al. |
| 6,206,237 | B1 | 3/2001 | Dillon et al. |
| 6,253,930 | B1 | 7/2001 | Freidus et al. |
| 6,267,258 | B1 | 7/2001 | Wilkerson et al. |
| 6,393,799 | B2 | 5/2002 | Jenkins et al. |
| 6,637,604 | B1 | 10/2003 | Jay |
| 6,802,433 | B2 | 10/2004 | Leykin |
| 6,991,116 | B2 | 1/2006 | Johnson et al. |
| 7,207,447 | B2 | 4/2007 | Medcalf et al. |
| 7,303,095 | B2 | 12/2007 | Nagelski et al. |
| 7,328,798 | B2 * | 2/2008 | Auclair et al. ..... 206/427 |
| 7,546,973 | B2 | 6/2009 | Budz et al. |
| 7,584,854 | B2 | 9/2009 | Chandaria |
| D604,972 | S | 12/2009 | Henry et al. |
| 7,665,618 | B2 | 2/2010 | Jay et al. |
| 7,681,745 | B2 | 3/2010 | Richter |
| 7,810,672 | B1 | 10/2010 | Mason et al. |
| 7,823,733 | B2 | 11/2010 | Futori |
| 7,850,015 | B1 | 12/2010 | Mason |
| 7,913,860 | B2 | 3/2011 | Merl |
| 7,918,365 | B2 | 4/2011 | White et al. |
| 7,922,437 | B1 | 4/2011 | Loftin et al. |
| 7,992,747 | B2 | 8/2011 | Bauer |
| 8,028,855 | B2 | 10/2011 | White et al. |
| 2002/0043509 | A1 | 4/2002 | Lajeunesse et al. |
| 2004/0011751 | A1 | 1/2004 | Johnson et al. |
| 2004/0262326 | A1 | 12/2004 | Christensen |
| 2005/0127015 | A1 | 6/2005 | Medcalf et al. |
| 2005/0207877 | A1 | 9/2005 | Haverdink |
| 2006/0081692 | A1 | 4/2006 | Stewart et al. |
| 2006/0237384 | A1 | 10/2006 | Neumann et al. |
| 2006/0278591 | A1 | 12/2006 | Tippets et al. |
| 2008/0067188 | A1 * | 3/2008 | White et al. ..... 221/123 |
| 2008/0245813 | A1 | 10/2008 | Johnson et al. |
| 2009/0212066 | A1 | 8/2009 | Bauer |
| 2009/0266776 | A1 | 10/2009 | Johnson |
| 2010/0032391 | A1 | 2/2010 | Schneider et al. |
| 2011/0121010 | A1 | 5/2011 | Loftin et al. |
| 2011/0121011 | A1 | 5/2011 | Gelardi et al. |

FOREIGN PATENT DOCUMENTS

| | | | |
|---|---|---|---|
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |

(56) References Cited

FOREIGN PATENT DOCUMENTS

| | | | |
|---|---|---|---|
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 2004113808 | | 12/2004 |
| WO | WO 2009138538 | | 11/2009 |

OTHER PUBLICATIONS

International Search Report and Written Opinion issued in PCT/US2010/057221 (Mar. 4, 2011).

* cited by examiner

PRODUCT DISPENSING SYSTEM WITH FLEXING CONTAINER

FIELD

This application relates to the dispensing of products from packaging containers and, more particularly, to dispensers for dispensing products initially provided in packaging containers.

BACKGROUND

Products are typically shipped to retailers in bulk by enclosing multiple individual product units in a container, such as a carton or box. For example, canned beverages may be shipped to a retailer in a carton containing twelve individual cans. When the products are to be sold individually, the retailer must remove the individual product units from the carton and stack them on a display, such as a shelf.

Alternatives to the traditional package-ship-unpack-display model have been developed in an effort to improve operating efficiency. For example, U.S. Ser. No. 13/184,639 filed on Jul. 18, 2011, the entire contents of which are incorporated herein by reference, discloses a gravity-fed product dispensing system with multiple dispensing decks. The system includes a dispenser configured with an upper deck for supporting a container and multiple dispensing decks positioned below the upper deck, wherein each dispensing deck includes a product display area. The dispenser may be positioned on a retailer's shelf and loaded with product simply by placing a container comprising multiple units of product onto the upper deck of the dispenser. Once the container is positioned on the upper deck, the products exit the container through an opening in the container and travel to the product display areas under the force of gravity. Consumers may retrieve the products from the product display areas.

Despite advances already made in the field, those skilled in the art continue with research and development efforts directed to apparatus and systems for dispensing products initially provided in packaging containers.

SUMMARY

In one aspect, the disclosed product dispensing system may include a dispenser including a frame structure having a first end longitudinally opposed from a second end, the frame structure including an upper support deck extending between the first end and the second end, the upper support deck defining a first opening, and a lower support deck positioned below the upper support deck, the lower support deck extending between the first end and the second end, the lower support deck defining a product display area, a container positioned on the upper support deck, the container including at least a first wall and a second wall that define an internal volume, wherein the first wall defines a second opening into the internal volume, the second opening having a longitudinal length and being aligned with the first opening, and wherein the second wall includes a lower portion proximate the second opening, and a plurality of products initially housed in the internal volume, wherein the frame structure is spaced from the lower portion of the second wall such that the lower portion bows outward and increases the longitudinal length when at least one product of the plurality of products engages the lower portion as it exits the container through the second opening and passes through the first opening.

In another aspect, the disclosed product dispensing system may include a container comprising at least a base wall and a rear wall that define an internal volume, wherein at least the base wall defines an opening into the internal volume, and wherein the rear wall includes a lower portion and an upper portion, the lower portion being proximate the opening in the container, a plurality of products initially housed in the internal volume, and a dispenser comprising a frame structure having a front end longitudinally opposed from a rear end, the frame structure including an upper support deck extending between the front end and the rear end, the upper support deck defining an opening proximate the rear end, a lower support deck positioned below the upper support deck, the lower support deck extending between the front end and the rear end, the lower support deck defining a product display area proximate the front end, a rear wall positioned proximate the rear end and extending between the upper support deck and the lower support deck, and a stop positioned proximate the rear end to engage the upper portion of the rear wall of the container and form a gap between the lower portion of the rear wall of the container and the rear wall of the frame structure when the container is urged along the upper support deck into engagement with the stop, wherein the lower portion bows outward into the gap when at least one product of the plurality of products engages the lower portion as the product exits the container through the opening in the container.

In yet another aspect, disclosed is a method for dispensing products. The method may include the steps of (1) providing a container initially housing a plurality of products, the container including at least a rear wall and a base wall, the rear wall including a lower portion, (2) forming an opening in the base wall proximate the lower portion of the rear wall, (3) providing a dispenser including a frame structure having a front end longitudinally opposed from a rear end, the frame structure including an upper support deck extending between the front end and the rear end, the upper support deck defining an opening proximate the rear end, a lower support deck positioned below the upper support deck, the lower support deck extending between the front end and the rear end, the lower support deck defining a product display area proximate the front end, and a rear wall positioned proximate the rear end and extending between the upper support deck and the lower support deck, and (4) positioning the container on the upper support deck such that the lower portion of the rear wall of the container is spaced a pre-determined distance from the rear wall of the dispenser and the opening in the container is aligned with the opening in the upper support deck.

Other aspects of the disclosed product dispensing system and method with flexing container will become apparent from the following detailed description, the accompanying drawings and the appended claims.

DETAILED DESCRIPTION

Figure 1:
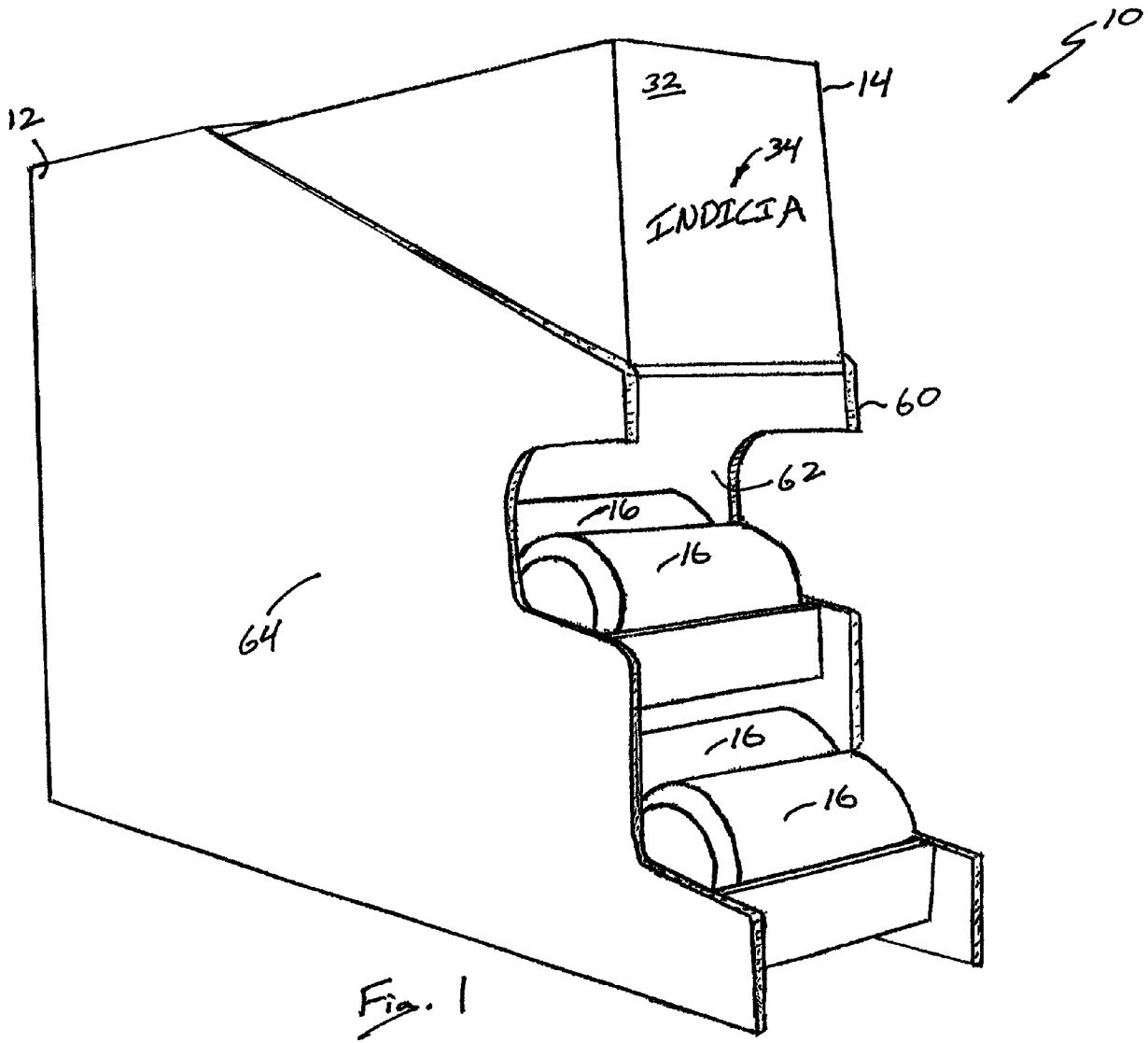
FIG. 1 is a front and side perspective view of one aspect of the disclosed product dispensing system with flexing container.
Figure 2:
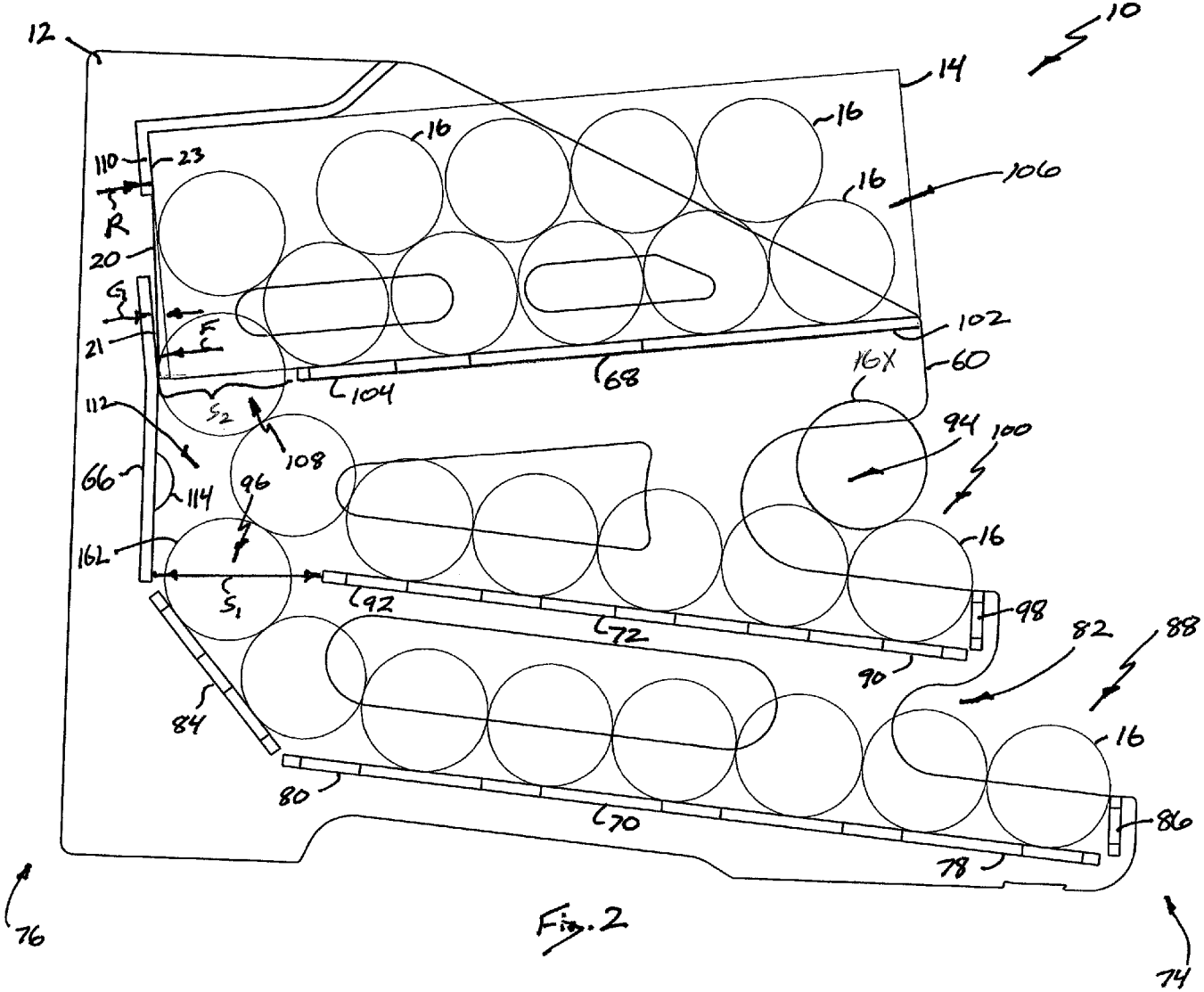
FIG. 2 is a side elevational view, in section, of the product dispensing system of FIG. 1.

Referring to FIGS. 1 and 2, one aspect of the disclosed product dispensing system with flexing container, generally designated 10, may include a dispenser 12 and a container 14. The container 14 may initially house multiple units of product 16, such as cans (e.g., canned soft drinks), jars (e.g., jarred soup) or bottles (e.g., bottled sauce). The products 16 may be released from the container 14 into the dispenser 12 when the container 14 is opened and positioned on the dispenser 12.

Figure 3:
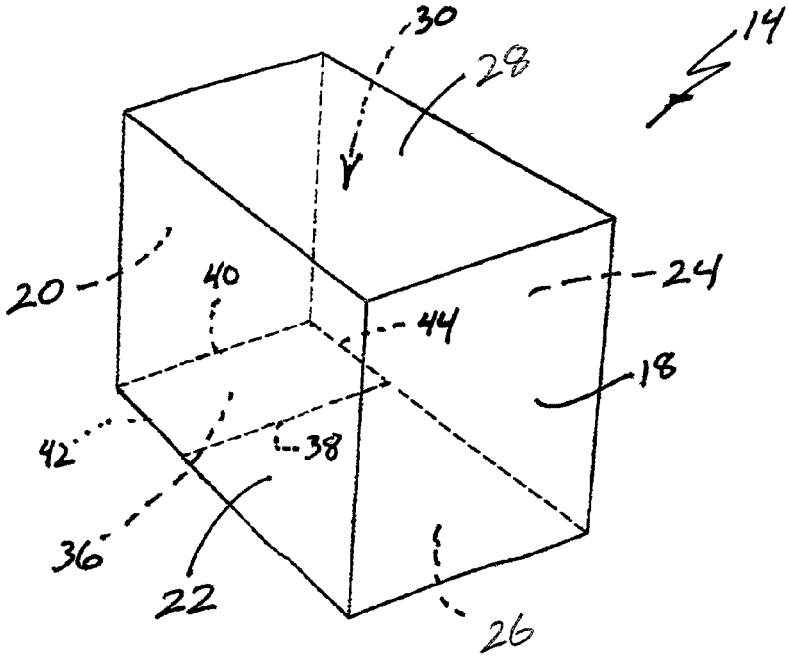
FIG. 3 is a front perspective view of the container of the product dispensing system of FIG. 1.

The container 14 may be any container capable of initially housing the products 16 and beneficially interacting with the dispenser 12. For example, as shown in FIG. 3, the container 14 may be a paperboard carton or a corrugated box having six walls 18, 20, 22, 24, 26, 28. Opposed walls 18, 20 may define the front and rear walls, respectively, of the container 14. Opposed walls 22, 24 may define the left and right side walls, respectively, of the container 14. Opposed walls 26, 28 may define the base and upper walls, respectively, of the container 14.

Figure 5:
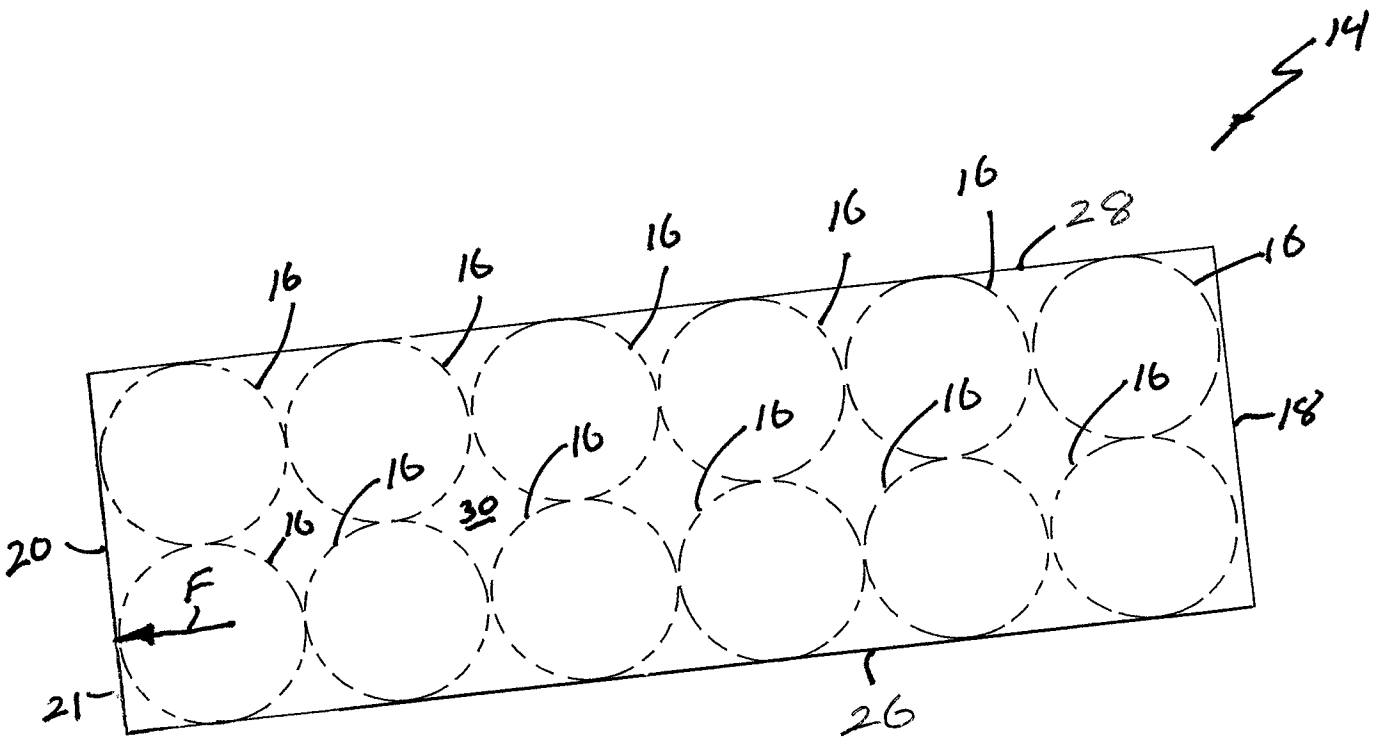
FIG. 5 is a side elevational view of the container of FIG. 3 shown with products housed therein.

As shown in FIG. 5, the walls 18, 20, 22, 24, 26, 28 of the container 14 may define an internal volume 30. The products 16 may be initially housed within the internal volume 30 of the container 14.

In accordance with well-established techniques, the container 14 may be assembled on a container machine using a container blank that has been pre-cut from a sheet of stock material. As one example, the stock material may be a paperboard-based material, such as C1S paperboard, which may have a coating (e.g., clay) on a first major surface thereof, which may form the outer surface of the container 14, and an uncoated second major surface. As another example, the stock material may be C2S paperboard, which may have a coating (e.g., clay) on both major surfaces thereof. Optionally, as shown in FIG. 1, the outer surface 32 of the container 14 may be marked with various indicia 34, such as printed text and graphics.

Referring back to FIG. 3, the container 14 may include a removable opening feature 36 in at least one wall (e.g., the base wall 26). The removable opening feature 36 may be defined by weakened severance lines 38, 40, 42, 44. The weakened severance lines 38, 40, 42, 44 may be formed by weakening the container 14, such as with score lines, perforations or zipper-like cuts, to facilitate tearing the removable opening feature 36 from the container 14 along the weakened severance lines 38, 40, 42, 44.

Figure 4:
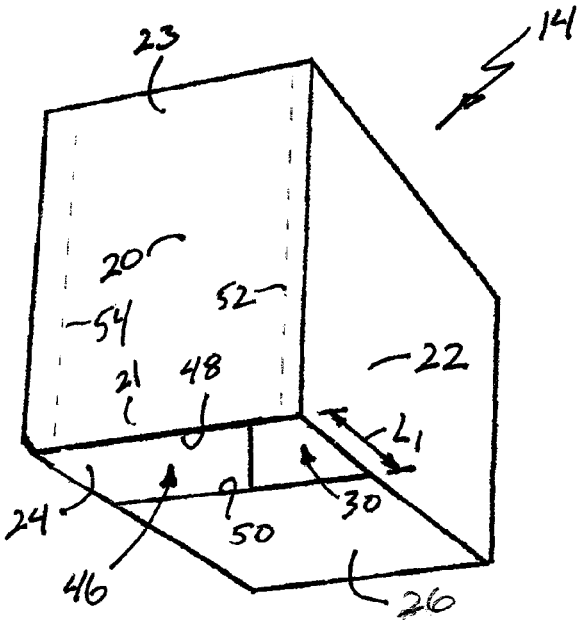
FIG. 4 is a rear and bottom perspective view of the container of FIG. 3 shown with an opening formed therein.

As shown in FIG. 4, the removable opening feature 36 (FIG. 3) may be removed from the container 14 to form an opening 46 into the internal volume 30 of the container 14. The opening 46 may extend generally laterally between the side walls 22, 24 of the container 14, and may be positioned proximate the rear wall 20 of the container 14. The longitudinal length L of the opening 46 (i.e., the shortest distance between edge 48 and edge 50) may be greater than the greatest diameter of the products 16, thereby ensuring that the products 16 are capable of passing through the opening 46.

At this point, those skilled in the art will appreciate that the step of removing the removable opening feature 36 from the container 14 may be performed prior to loading the container 14 onto the dispenser 12. However, in an alternative embodiment, the dispenser 12 may include an opening tool (not shown) arranged to automatically form the opening 46 in the container 14 as the container 14 is loaded onto the dispenser 12 (e.g., by sliding the container 14 longitudinally along the upper support deck 58 of the dispenser 12). The use of an opening tool associated with a dispenser to automatically form an opening in a container is described in greater detail in U.S. Ser. No. 13/184,639 (discussed above), as well as in U.S. Pat. No. 7,922,437 issued on Apr. 12, 2011, the entire contents of which are incorporated herein by reference.

Figure 6:
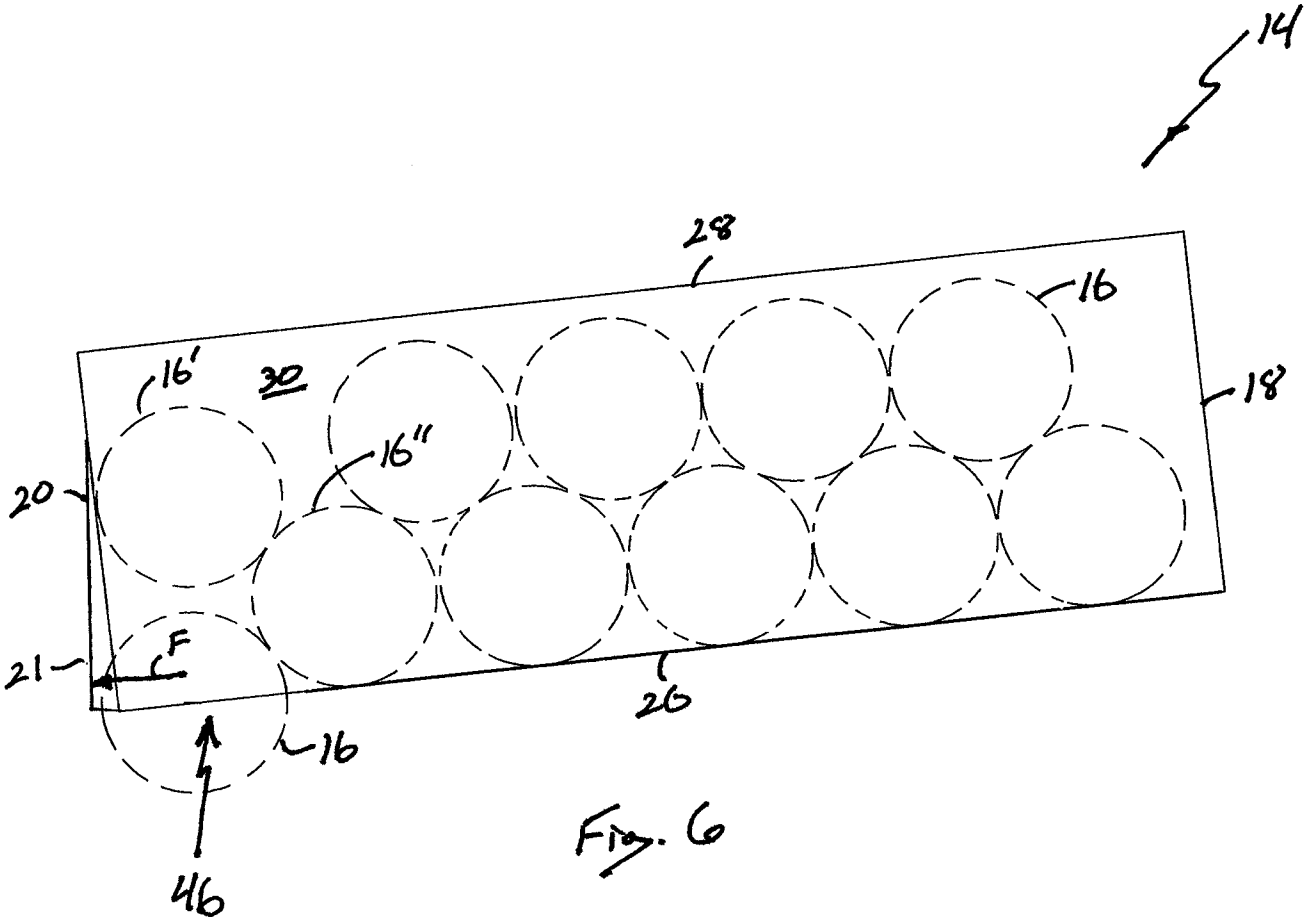
FIG. 6 is a side elevational view of the container of FIG. 4 shown in a flexed configuration with products exiting the container through the opening.
Figure 7:
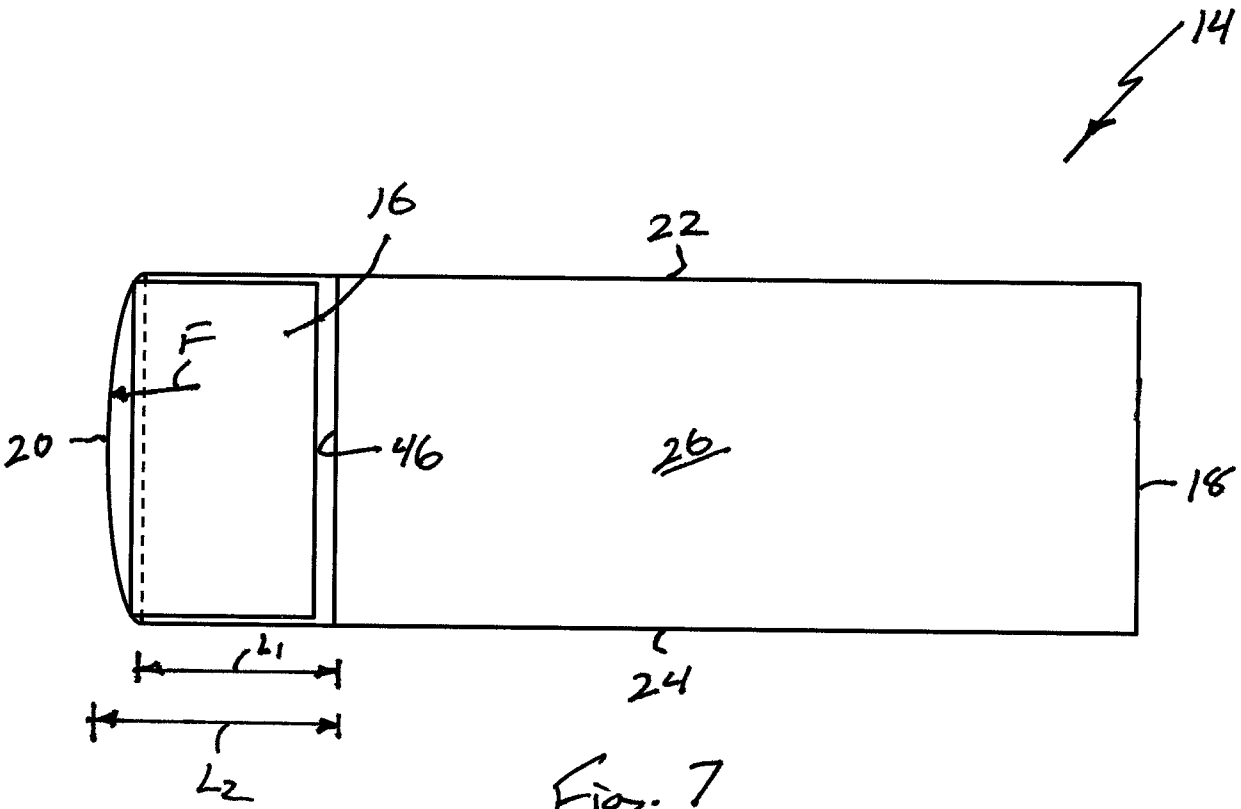
FIG. 7 is bottom plan view of the container of FIG. 6

Thus, as shown in FIGS. 5-7, products 16 initially housed in the internal volume 30 of the container 14 may exit the container 14 through the opening 46.

Referring to FIGS. 6 and 7, as a product 16 exits the container 14 through the opening 46, the weight (force F) of the product 16 against the lower portion 21 of the rear wall 20 of the container 14 may cause the rear wall 20 to flex and bow longitudinally outward (i.e., in the direction of arrow F). Such flexing of the rear wall 20 may increase the longitudinal length L of the opening 46. Specifically, such flexing of the rear wall 20 may extend the longitudinal length of the opening 46 from an initial longitudinal length $L_1$ to an extended longitudinal length $L_2$, as shown in FIG. 7.

Referring back to FIG. 4, the rear wall 20 of the container 14 may be provided with pre-formed flex lines 52, 54. Pre-formed flex line 52 may be formed in the rear wall 20 proximate the left side wall 22 of the container 14, and may extend upward (vertically or otherwise) from proximate the base wall 26. Pre-formed flex line 54 may be formed in the rear wall 20 proximate the right side wall 24 of the container 14, and may extend upward (vertically or otherwise) from proximate the base wall 26.

The pre-formed flex lines 52, 54 may be formed by weakening the container 14 along the pre-formed flex lines 52, 54. Examples of weakening techniques useful in forming the pre-formed flex lines 52, 54 include scoring the container 14, creasing the container 14 and forming perforations in the container 14.

Thus, the pre-formed flex lines 52, 54 may facilitate controlled flexing (i.e., outward bowing) of the rear wall 20 of the container 14 (i.e., flexing primarily along the pre-formed flex lines 52, 54) when the removable opening feature 36 (FIG. 3) is removed to form the opening 46 and a force F (FIGS. 6 and 7) is applied to the lower portion 21 of the rear wall 20.

Significant product bridging has been observed in containers 14 in which the rear wall 20 is not permitted to flex, requiring manual intervention to undo the bridging. With reference to FIG. 6, product bridging often occurs when product 16' becomes wedged between the rear wall 20 and product 16", thereby preventing either product 16' or product 16" from passing through the opening 46. Without being limited to any particular theory, it is believed that encouraging flexing of the rear wall 20 to increase the longitudinal length of the opening 46 from an initial longitudinal length $L_1$ to an extended longitudinal length $L_2$ may minimize (if not eliminate) the occurrence of product bridging within the container 14 because the flexing of the rear wall 20 allows product 16' to move around product 16".

Referring back to FIGS. 1 and 2, the dispenser 12 may include a frame structure 60 that supports the container 14 and products 16 in a desired configuration. The frame structure 60 may include a first (e.g., right) side wall 62, a second (e.g., left) side wall 64, a rear wall 66, an upper support deck 68, a lower support deck 70 and, optionally, one or more intermediate support decks 72 positioned between the upper support deck 68 and the lower support deck 70. The frame structure 60 may include a front end portion 74 and a rear end portion 76, wherein the rear end 76 is longitudinally opposed from the front end 74.

The right side wall 62 may be laterally spaced from the left side wall 64, and may be generally parallel with the left side wall 64. The spacing between the right and left side walls 62, 64 may be sized to closely receive the products 16 in a rolling configuration, thereby providing lateral containment for the products 16 within the frame structure 60.

The rear wall 66 may be positioned proximate the rear end 76 of the frame structure 60, and may laterally extend between the right and left side walls 62, 64. The rear wall 66 may be generally vertically arranged, though an angled rear wall 66 (i.e., angled relative to vertical in side view) may be used without departing from the scope of the present disclosure.

The lower support deck 70 may laterally extend between the right and left side walls 62, 64, and may include a front end 78 that longitudinally extends toward the front end 74 of the frame structure 60 and a rear end 80 that longitudinally extends toward the rear end 76 of the frame structure 60. Therefore, the lower support deck 70 and the side walls 62, 64 may define a lower level 82 of the frame structure 60.

The lower support deck 70 may be inclined from the front end 78 to the rear end 80 (i.e., the rear end 80 may be elevated relative to the front end 78) such that products 16 deposited proximate the rear end 80 of the lower support deck 70 roll down to the front end 78 of the lower support deck 70 under the force of gravity. The extent of the incline of the lower support deck 70 may be dictated by, among other things, the coefficient of friction of the material used to form the frame structure 60 and the shape of the products 16 to be dispensed by the dispenser 12.

A ramp 84 may be positioned between the rear wall 66 of the frame structure 60 and the rear end 80 of the lower support deck 70. The ramp 84 may provide a gradual vertical-to-horizontal transition for products 16 dropping down to the lower level 82 of the frame structure 60.

A stop 86 may be positioned proximate the front end 78 of the lower support deck 70 to prevent products 16 from rolling beyond the front end 78 of the lower support deck 70. Therefore, the stop 86 may collect products 16 at the front end 78 of the lower support deck 70, thereby defining a first product display area 88 proximate the front end 78 of the lower support deck 70. The first product display area 88 may be configured to allow consumers to retrieve products 16 from the lower level 82 of the dispenser 12.

The intermediate support deck 72 may be positioned between the upper support deck 68 and the lower support deck 70. The intermediate support deck 72 may laterally extend between the right and left side walls 62, 64, and may include a front end 90 that longitudinally extends toward the front end 74 of the frame structure 60 and a rear end 92 that longitudinally extends toward, but not to, the rear wall 66 of the frame structure 60. Therefore, the intermediate support deck 72 and the side walls 62, 64 may define an intermediate level 94 of the frame structure 60.

The spacing $S_1$ between the rear end 92 of the intermediate support deck 62 and the rear wall 66 of the frame structure 60 may define an opening 96, which may function as a chute to allow products 16 to move from the intermediate level 94 down to the lower level 82 of the frame structure 60 under the force of gravity.

The intermediate support deck 72 may be inclined from the front end 90 to the rear end 92 (i.e., the rear end 92 may be elevated relative to the front end 90) such that products 16 deposited proximate the rear end 92 of the intermediate support deck 72 roll down to the front end 90 of the intermediate support deck 72 under the force of gravity. The extent of the incline of the intermediate support deck 72 may be dictated by, among other things, the coefficient of friction of the material used to form the frame structure 60 and the shape of the products 16 to be dispensed by the dispenser 12.

A stop 98 may be positioned proximate the front end 90 of the intermediate support deck 72 to prevent products 16 from rolling beyond the front end 90 of the intermediate support deck 72. Therefore, the stop 98 may collect products 16 at the front end 90 of the intermediate support deck 72, thereby defining a second product display area 100 proximate the front end 90 of the intermediate support deck 72. The second product display area 100 may be configured to allow consumers to retrieve products 16 from the intermediate level 94 of the dispenser 12.

In one optional construction, the second product display area 100 may be longitudinally (e.g., inwardly) displaced relative to the first product display area 88 such that the second product display area 100 does not obstruct access to the first product display area 88. As an example, the longitudinal displacement may correspond to the width of one product 16.

In another optional construction, the vertical spacing between the intermediate support deck 72 and the upper support deck 68 may be increased such that a product 16X may be stacked on top of the product(s) 16 on the intermediate support deck 72. Therefore, consumers may return unwanted products 16X to the dispenser 12 by stacking the unwanted products 16X on top of the products 16 on the intermediate support deck 72.

The upper support deck 68 may laterally extend between the right and left side walls 62, 64, and may include a front end 102 that longitudinally extends toward the front end 74 of the frame structure 60 and a rear end 104 that longitudinally extends toward, but not to, the rear wall 66 of the frame structure 60. Therefore, the upper support deck 68 and the side walls 62, 64 may define an upper level 106 of the frame structure 60.

The spacing $S_2$ between the rear end 104 of the upper support deck 68 and the rear wall 66 of the frame structure 60 may define an opening 108, which may function as a chute to allow products 16 to move from the upper level 106 down to the intermediate 94 and lower 82 levels of the frame structure 60 under the force of gravity.

The upper support deck 68 may be declined from the front end 102 to the rear end 104 (i.e., the front end 102 may be elevated relative to the rear end 104). Therefore, products 16 supported on the upper support deck 68 may roll under the force of gravity down to the rear end 104 of the upper support deck 68, through the opening 108, to the lower and intermediate levels 82, 94 of the frame structure 60 and, ultimately, to the first and second product display areas 88, 100.

Thus, the openings 96, 108 in the intermediate and upper levels 94, 106, respectively, may define a vertical drop zone 112 proximate the rear end 76 of the frame structure 60. The vertical drop zone 112 may extend from the upper level 106 to the lower level 82 of the frame structure 60. Products 16 exiting the opening 46 (FIG. 4) in the container 14 may fall through at least a portion of the vertical drop zone 112 as the products 16 travel (under the force of gravity) to either the lower level 82 or the intermediate level 94 and, ultimately, to either the first product display area 88 or the second product display area 100.

A stop 110 may be positioned in the upper level 106 of the frame structure 60 proximate the rear end 76 of the frame structure 60. The stop 110 may inhibit rearward horizontal movement of the container 14 along the upper support deck 68 beyond the stop 110, thereby facilitating the alignment of the opening 46 (FIG. 4) in the container 14 with the opening 108 of the upper level 106 of the frame structure 60 when the container 14 is mounted on the dispenser 12.

The stop 110 may be arranged to apply a reactive force (arrow R) to the upper portion 23 of the rear wall 20 of the container 14 without applying a reactive force to the lower portion 21 of the rear wall 20. Furthermore, the stop 110 may be arranged such that the lower portion 21 of the rear wall 20 of the container is longitudinally displaced slightly forward from the rear wall 66 of the frame structure 60. Therefore, the stop 110 may establish a gap G between the rear wall 66 of the frame structure 60 and the lower portion 21 of the rear wall 20 of the container 14, thereby allowing the lower portion 21 of the rear wall 20 of the container 14 to flex and bow longitudinally outward (i.e., in the direction of arrow F) without interference from the dispenser 12 as products 16 exit the container 14 through the opening 46.

The size of the gap G may be dictated by the difference between the extended longitudinal length $L_2$ (FIG. 7) of the opening 46 and the initial longitudinal length $L_1$ (FIG. 7) of the opening 46. For example, when the longitudinal length of the opening 46 is extended by 0.25 inches when the lower portion 21 of the rear wall 20 of the container 14 flexes and bows longitudinally outward, the gap G may be at least 0.25 inches wide.

At this point, those skilled in the art will appreciate that a gap G may only be required when the frame structure 60 interferes with the flexing and outward bowing of the lower portion 21 of the rear wall 20 of the container 14. There may be no need for a gap G when there is no structure, such as the rear wall 20 of the frame structure 60, immediately behind the lower portion 21 of the rear wall 20 of the container 14.

The product dispensing system 10 may be assembled by opening the container 14 (e.g., tearing away the removable opening feature 36) and urging the opened container 14 along the upper support deck 68 of the dispenser 12 until the rear wall 20 of the container 14 comes into abutting engagement with the stop 110, thereby aligning the opening 46 in the container 14 with the opening 108 in the upper level 106 of the frame structure 60. With the opened container 14 loaded onto the dispenser 12, the force of gravity may urge the products 16 in the container 14 down toward the rear wall 20 of the container 14 and, ultimately, through the opening 46 in the container 14. The force F of the products 16 acting on the rear wall 20 of the container 14 may cause the rear wall 20 to flex and bow outward, thereby extending the longitudinal length L of the opening 46 and allowing the products 16 to move through the opening 46 without bridging within the container 14.

Once the products 16 have passed through the opening 46, the products 16 may move through the vertical drop zone 112 of the frame structure 60 and, ultimately, to either the first product display area 88 or the second product display area 100. Once the products from the container 14 have been transferred to the dispenser 12, a second container may be positioned on the upper support deck 68 of the dispenser 12. The products 16 in the second container may fill the dispenser 12 as customers remove products 16 by way of the first and second product display areas 88, 100.

An optional guide 114 may be positioned proximate the rear wall 66 of the frame structure 60 below the upper support deck 68, but above the intermediate support deck 72. The guide 114 may protrude into the vertical drop zone 112 to beneficially interact with products 16 moving through the vertical drop zone 112. Specifically, the guide 114 may introduce a slight forward, horizontal movement to the products 16 dropping through the vertical drop zone 112 into engagement with the guide 112. The introduction of a slight forward, horizontal movement to the products 16 dropping through the vertical drop zone 112 may minimize (if not eliminate) the potential for products 16 becoming stuck on top of the last product 16L in the lower level 82 and forming a bridge that clogs the system 10 (e.g., prevents products 16 from moving onto the intermediate support deck 72).

Accordingly, the disclosed product dispensing system may include a container and a dispenser, wherein the container and dispenser are configured to achieve beneficial flexing and outward bowing of the rear wall of the container as products exit the container under the force of gravity and move to the dispenser. Such beneficial flexing may be achieved by creating a gap between the frame structure and the lower portion of the rear wall of the container or, alternative, removing altogether any portion of the frame structure immediately behind the lower portion of the rear wall of the container. It is believed that product bridging within the container may be minimized (if not eliminated) by encouraging such flexing and outward bowing of the rear wall of the container.

Although various aspects of the disclosed product dispensing system with flexing container have been shown and described, modifications may occur to those skilled in the art upon reading the specification. The present application includes such modifications and is limited only by the scope of the claims.

What is claimed is:

1. A product dispensing system comprising:

a dispenser comprising a frame structure having a first end longitudinally opposed from a second end, said frame structure comprising:

an upper support deck extending between said first end and said second end, said upper support deck defining a first opening; and a lower support deck positioned below said upper support deck, said lower support deck extending between said first end and said second end, said lower support deck defining a product display area;

a container positioned on said upper support deck, said container comprising at least a first wall and a second wall that define an internal volume, wherein said first wall defines a second opening, said second opening has a longitudinal length and is aligned with said first opening, and wherein said second wall comprises a lower portion proximate said second opening and a pair of pre-formed flex lines, each pre-formed flex line extending upward from proximate said second opening; and a plurality of products initially housed in said internal volume, wherein said frame structure is spaced from said lower portion of said second wall such that said lower portion is free to bow outward and increase said longitudinal length when at least one product of said plurality of products engages said lower portion as said product exits said container through said second opening, and wherein said pair of pre-formed flex lines is configured to facilitate controlled flexing of said second wall outward toward said frame structure when said product engages said lower portion as said product exits said container through said second opening.

2. The product dispensing system of claim 1 wherein said first opening is proximate said rear end of said frame structure.

3. The product dispensing system of claim 1 wherein said product display area is proximate said front end of said frame structure.

4. The product dispensing system of claim 1 wherein said frame structure further comprises an intermediate support deck positioned between said upper support deck and said lower support deck, said intermediate support deck extending between said front end and said rear end and defining a second product display area.

5. The product dispensing system of claim 4 wherein said second product display area is proximate said front end of said frame structure.

6. The product dispensing system of claim 1 wherein said frame structure further comprises a rear wall proximate said rear end of said frame structure.

7. The product dispensing system of claim 6 wherein said rear wall is spaced from said lower portion of said second wall such that said lower portion bows outward and increases said longitudinal length when said product engages said lower portion as it exits said container through said second opening.

8. The product dispensing system of claim 6 wherein said frame structure further comprises a stop proximate said rear end, said stop being positioned to engage said second wall as said container is horizontally urged along said upper support deck.

9. The product dispensing system of claim 8 wherein said stop is arranged to form a gap between said rear wall of said frame structure and said lower portion of said second wall of said container.

10. A product dispensing system comprising:

a dispenser comprising a frame structure having a front end longitudinally opposed from a rear end, said frame structure comprising:

an upper support deck extending between said front end and said rear end, said upper support deck defining a first opening proximate said rear end;

a lower support deck positioned below said upper support deck, said lower support deck extending between said front end and said rear end, said lower support deck defining a product display area proximate said front end; and a rear wall positioned proximate said rear end and extending between said upper support deck and said lower support deck; and a stop positioned proximate said rear end, said stop being longitudinally displaced from said rear wall such that said stop is positioned between said rear wall and said front end;

a container comprising at least a base wall and a rear wall that define an internal volume, wherein at least said base wall defines a second opening into said internal volume, and wherein said rear wall comprises a lower portion and an upper portion, said lower portion being proximate said second opening in said container and said upper portion being in contact with said stop upon said container being supported on said upper support deck, and wherein said rear wall further comprises a pair of pre-formed flex lines, each pre-formed flex line extending upward from proximate said second opening; and a plurality of products initially housed in said internal volume;

wherein said rear wall of said frame structure is spaced from said lower portion of said rear wall of said container by said stop such that said lower portion is free to bow outward and increase said longitudinal length when at least one product of said plurality of products engages said lower portion as said product exits said container through said second opening, and wherein said pair of pre-formed flex lines is configured to facilitate controlled flexing of said rear wall toward said rear end of said frame structure when said product engages said lower portion as said product exits said container through said second opening.

11. The product dispensing system of claim 10 wherein said stop is positioned to engage said upper portion of said rear wall of said container and form a gap between said lower portion of said rear wall of said container and said rear wall of said frame structure and align said opening in said container with said opening in said upper support deck when said container is urged along said upper support deck into engagement with said stop.

12. The product dispensing system of claim 11 wherein said lower portion bows outward into said gap when at least one product of said plurality of products engages said lower portion as said product exits said container through said opening in said container.

13. The product dispensing system of claim 12 wherein said opening is said container has a first longitudinal length when said lower portion is not bowed outward into said gap and a second longitudinal length when said lower portion is bowed outward into said gap, said second longitudinal length being greater than said first longitudinal length.

14. A method for dispensing products comprising the steps of:

providing a container initially housing a plurality of products, said container comprising at least a rear wall and a base wall, said rear wall comprising a lower portion and a pair of pre-formed flex lines;

forming an opening in said base wall proximate said lower portion of said rear wall, wherein each pre-formed flex line extends upward from proximate said opening;

providing a dispenser comprising a frame structure having a front end longitudinally opposed from a rear end, said frame structure comprising:

an upper support deck extending between said front end and said rear end, said upper support deck defining an opening proximate said rear end;

a lower support deck positioned below said upper support deck, said lower support deck extending between said front end and said rear end, said lower support deck defining a product display area proximate said front end; and a rear wall positioned proximate said rear end and extending between said upper support deck and said lower support deck; and positioning said container on said upper support deck such that said lower portion of said rear wall of said container is spaced a pre-determined distance from said rear wall of said dispenser and is free to bow outward along said pair of pre-formed flex lines and said opening in said container is aligned with said opening in said upper support deck.

15. The method of claim 14 wherein said lower portion bows outward toward said rear wall of said dispenser when at least one product of said plurality of products engages said lower portion as said product exits said container through said opening in said container.

16. The method of claim 15 wherein said product moves to said product display area under the force of gravity after said product exits said container through said opening in said container.

17. The method of claim 15 wherein said opening in said container has a longitudinal length, and wherein said longitudinal length increases when said lower portion bows outward toward said rear wall.

18. The method of claim 14 wherein said pre-determined distance is at least 0.25 inches.

* * * * *